US006907642B1

(12) United States Patent
Czipri

(10) Patent No.: US 6,907,642 B1
(45) Date of Patent: Jun. 21, 2005

(54) QUICK RELEASE BIMINI HINGE

(75) Inventor: John Czipri, Palm Harbor, FL (US)

(73) Assignee: R & D Shed, L.L.C., Palm Harbor, FL (US)

( * ) Notice: Subject to any disclaimer, the term of this patent is extended or adjusted under 35 U.S.C. 154(b) by 0 days.

(21) Appl. No.: 10/351,540

(22) Filed: Jan. 27, 2003

(51) Int. Cl.[7] ..... E05D 3/10

(52) U.S. Cl. ..... 16/367; 16/258; 248/278.1; 114/364

(58) Field of Search ..... 16/367, 258, 231, 16/232, 380, 381; 248/278.1; 114/364, 249, 250

(56) References Cited

U.S. PATENT DOCUMENTS 1,396,247 A 11/1921 Bowman
4,319,746 A * 3/1982 Chang ..... 472/4
4,458,870 A * 7/1984 Duncan et al. ..... 248/279.1
4,799,444 A 1/1989 Lisowski
5,092,262 A * 3/1992 Lacy ..... 114/361
5,413,063 A 5/1995 King
6,070,295 A * 6/2000 Hulsebus ..... 16/254
6,151,756 A 11/2000 Czipri
6,220,556 B1 * 4/2001 Sohrt et al. ..... 248/279.1
6,367,756 B1 * 4/2002 Wang ..... 248/278.1
6,594,860 B2 * 7/2003 Czipri ..... 16/367

* cited by examiner

*Primary Examiner*—Lynne H. Browne
*Assistant Examiner*—Christopher Boswell
(74) *Attorney, Agent, or Firm*—McKee, Voorhees & Sease, P.L.C.

(57) ABSTRACT

A Bimini hinge with a base member having an upper surface and a lower mounting surface and a vertically extending cylindrical opening therein. An intermediate member has a lower cylindrical surface that is received in the base member, and a latching member carried by the intermediate member secures the intermediate member to the base member for relative indexed rotation. The remote end of the intermediate member is pivotally secured to a mounted member, and the remote end of the latter is formed for securement of an item such as a Bimini Top.

13 Claims, 4 Drawing Sheets

QUICK RELEASE BIMINI HINGE

BACKGROUND OF THE INVENTION

1) Field of the Invention

This invention relates generally to bimini hinges, and more particularly to a Bimini hinge that will accommodate relative movement between the hinge members and is capable of being quickly released.

2) Description of the Prior Art

Bimini hinges are well known in the prior art and have particular application, inter alia, as a hinge for a convertible Bimini Top of a boat, that is a type of convertible top which can be raised to an upright usable position and lowered therefrom to a lowered unused or stored position. Such a hinge must have a base which can be mounted on a vessel, and a part carried by and pivotal relative to the base and securable to the Bimini top so that the Bimini Top can be moved between its positions. Such a Bimini hinge is shown in my U.S. Pat. No. 6,151,756, which has these desirable characteristics, however, this hinge requires that a receiving opening be provided in the boat hull to accommodate the housing which depends from the mounting flange. All boat manufacturers do not desire to have such an opening in their boat and all boat mounting surfaces are not conducive to having a receiving opening therein. Additionally, the two parts of the hinge are not easily separated, so that when a Bimini is removed from the prior art hinge, as for storage, the Bimini is detached from the hinge and the two portions of the hinge remain secured to the boat. In this condition the pivoting portion of the hinge projects from the base and becomes an obstruction for the boat operator, as disassembly of the hinge is difficult.

In my co pending application entitled Universal Hinge, Ser. No. 09/808,967, I have provided a universal hinge useable for a bimini application wherein the base of the hinge does not project below the surface upon which it is mounted and wherein the hinge elements are easily dissembled so that when the pivoting portion is removed from the base portion, there is little structure present to interfere with a user, and what little is present is smoothly unobtrusive. This hinge includes a base which is securable to a surface such as a boat hull or cabin, and does not project below this surface. The base has a smooth arcuate upper surface with a receiving opening therein, and includes in the base a latching lever which is spring loaded to project into the receiving opening and which lever is manually operable to be withdrawn from the projecting position. A hinge intermediate member is rotatably received in the receiving opening and has a detent groove for receiving the latching lever to retain the intermediate member in the opening, and alternately, when the latch is withdrawn, to be removed from the opening to disassemble the parts. The intermediate member has an axial slot there in for pivotally receiving a tang carried by the mounted member to be mounted thereon, and a pivot pin transverses the slot and the tang to pivotally mount the mounted member to the intermediate member, whereby the mounted member is universally hinged relative to the base. It should be noted that the latching lever is a part of the base member, and when the intermediate member is withdrawn, the latching lever is exposed to the elements.

SUMMARY OF THE INVENTION

The bimini hinge of the present invention is an improvement over this latter device, in that the latching lever is carried by and is a part of the intermediate member and thus when the Bimini is removed from a boat, and the intermediate member goes along with the bimini, the latching member, which is a part of the intermediate member and is not a part of the base, goes with and is stored along with the intermediate member and the bimini so that the latching member is not exposed to the elements at this time. The base of the present invention can also include spaced detent receivers which are engageable by a detent on latching lever of the intermediate member, so that while the intermediate member can be received by and rotated relative to the base member, the latching lever, upon moving to its latched position, indexes the position of the intermediate member. The base of the present invention can be mounted with very little thereof, namely a flange, projecting above the surface upon which it is mounted in which case a receiving portion thereof projects into the mounting surface, or the base can be modified for surface mounting so that none of the base projects into the surface supporting the same, or else the base can be easily modified for rail mounting, and in each of these instances the same intermediate member can be used therewith.

DETAILED DESCRIPTION OF THE INVENTION

Figure 4:
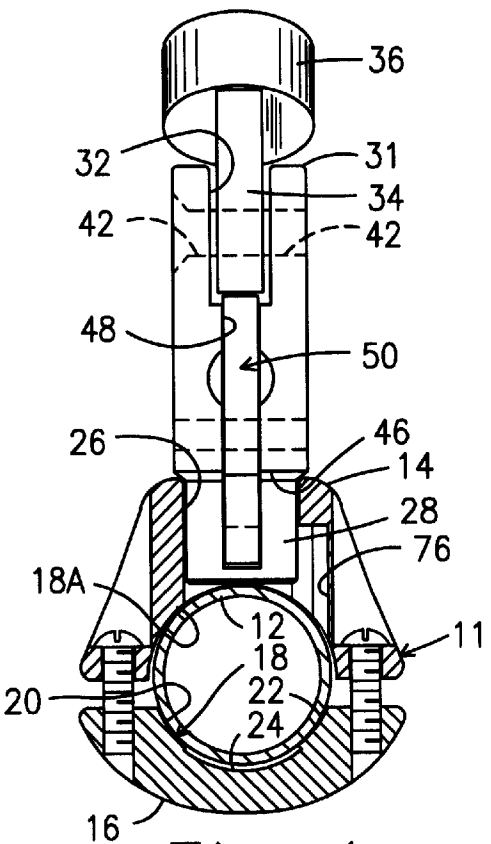
FIG. 4 is a cross sectional view of the embodiment of FIG. 1 taken along the line 4—4 in FIG. 1.

Referring now to the drawings, and more particularly to FIGS. 1–6, a Bimini hinge assembly adapted for rail mounting is shown generally at 10 mounted on a boat rail shown fragmentarily at 12. The hinge 10 includes a base 11 having an upper base portion 14 received on the rail 12 and secured to a lower base portion 16 disposed on the opposite side of the rail by a pair of lateraly spaced bolts 15. Referring to FIG. 4, the rail receiving opening 18 in the lower base portion 16 is provided with a pair of circumferentially spaced lands 20 an 22 generated with a curvature having a one-half inch radius, with these spaced lands being spaced by an intermediate land 24 which is depressed relative to the lands 20 and 22. The rail receiving opening 18A in the upper base portion 14 can conveniently have a one inch diameter. Thus, since the standard rail size for most vessels using a Bimini is either a one inch orseven-eights inch diameter, if the base 11 is used with a one inch diameter rail, as shown in FIG. 4, the spaced lands 20 will give a secure arcuate contact with the rail, while if the base 11 is used with a rail having a seven-eights inch diameter, the inner corners of the lands 20 and 22 will give a secure contact. It should be noted that the base portions 14 and 16 can be secured either horizontally or vertically (or for that matter any angular intermediate position) on the rail 12, and at any longitudinal position along the rail as desired and the position can also easily be adjusted by releasing and then securing the bolts 15.

The upper base portion 14 of the base 11 has a vertically extending receiving opening 26 (most clearly seen in FIGS. 4, 5 and 6) in which is received an annular depending portion 28 of an intermediate member 30 in a closely spaced supportable yet rotatable relationship. The intermediate member 30 has an outer end 31 opposite to its depending portion 28, in which outer end is a slot 32 for receiving a tang 34 formed on a boss 36, which boss has an opening 38 formed therein on the end thereof opposed to the tang 34 for conventionally receiving a leg of a Bimini frame (not shown). The tang 34 has a transverse opening 40 therein in registration with in line openings 42 formed in the outer end 31 of the intermediate member 30, and a pivot pin 41 is received in the openings 40 and 42 to pivotly mounting the boss 36 onto the intermediate member 30.

Figure 1:
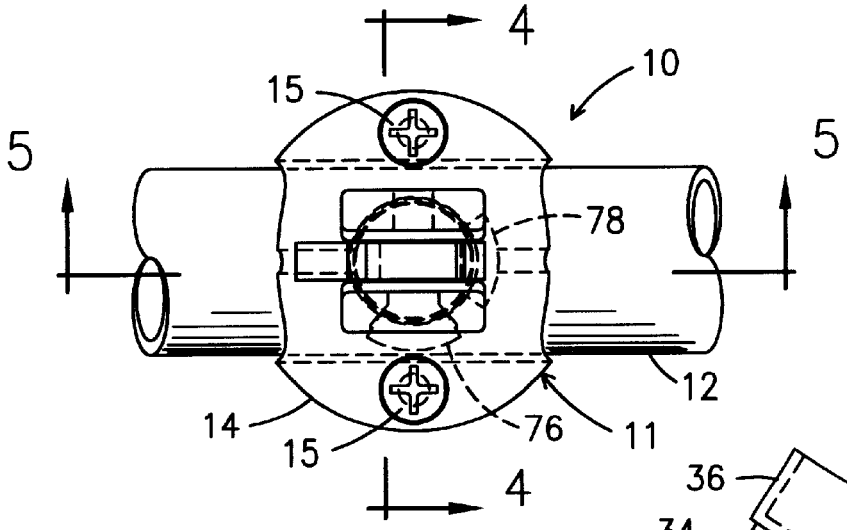
FIG. 1 is a plan view of a first embodiment of this invention.
Figure 2:
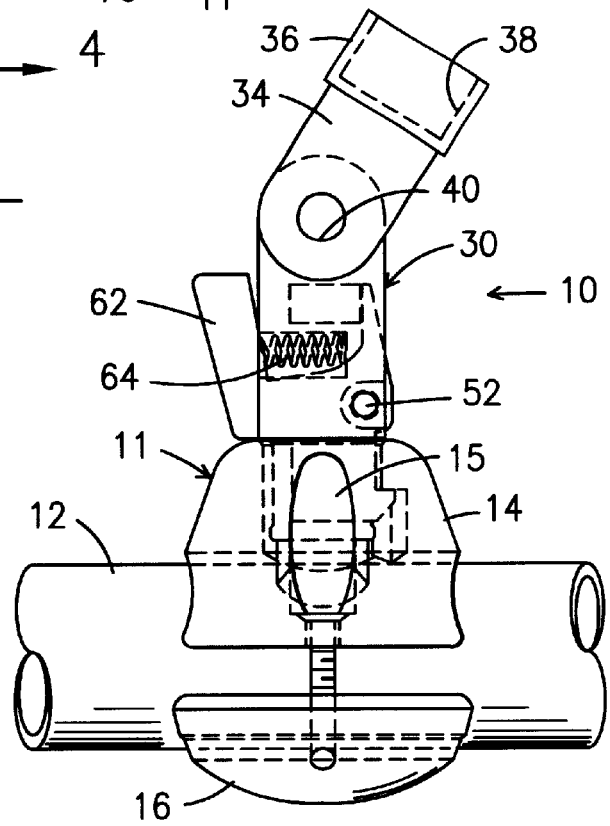
FIG. 2 is a side elevational view of the embodiment of FIG. 1.
Figure 3:
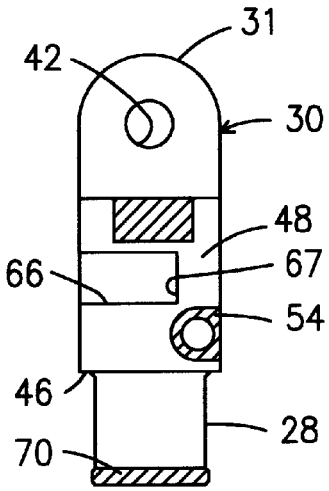
FIG. 3 is a longitudinal cross sectional view of a portion of the intermediate member of this invention, which portion is useable with all the embodiments disclosed herein.
Figure 6:
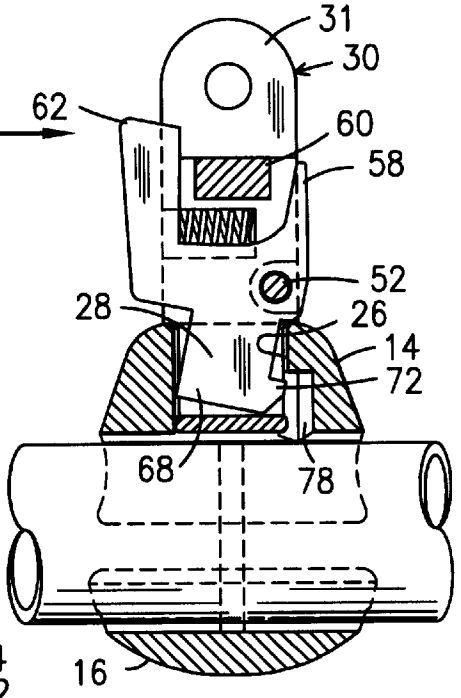
FIG. 6 is a cross sectional view taken in the same manner as FIG. 5 but with the latching lever in is disengaged position.
Figure 5:
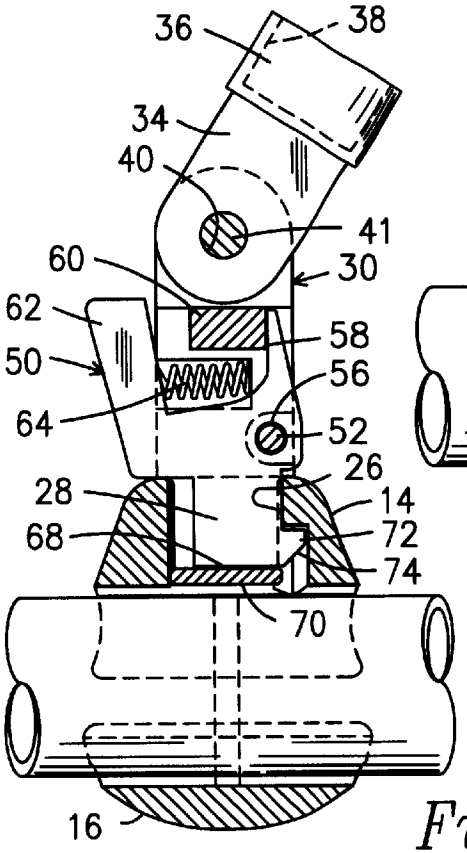
FIG. 5 is a cross sectional view taken along the line 5—5 in FIG. 1 with the latching lever in its engaged position.

A shoulder 46 is formed on the intermediate member 30 at the top of the depending portion 28, which shoulder abuttingly engages for relative rotation the top of the upper base portion 14 to limit further inward movement of the depending portion 28 into the base member 14. The intermediate member 30 has a slot 48 formed therein in which is received a latching lever 50, the latter being mounted on a pivot pin 52 mounted in a boss 54 formed in the intermediate member. The latching lever 50 is generally "Y" shaped and has an opening 56 therein receiving the pivot pin 52, and as seen in FIGS. 2, 4 and 5, its right arm 58 is engageable with a shoulder 60 formed on the intermediate member 30 for limiting counterclockwise rotation of the lever 50 relative thereto to the position seen in FIG. 5. The left arm 62 of the lever 50 projects from the slot 48 of the intermediate member 30 so that it may be pressed on to cause the lever 50 to rotate clockwise from its position seen in FIG. 5 to the position seen in FIG. 6. A coiled compression spring 64 is disposed in an opening 66 in the member 30 and is compressed between the right end or bottom 67 of the opening and the right side of the left arm 62 of the latching lever 50 to bias the lever to its position seen in FIGS. 2 and 5, while being compressible so as to allow the lever to move to its position shown in FIG. 6. The lower end 68 of the lever 50 is smaller in width than the diameter of the annular depending portion of the intermediate member and terminates slightly above a solid portion 70 formed in the bottom of the intermediate member at the lower end of the slot 48. The lower end 68 has a tang 72 projecting laterally therefrom, which tang, when in the position seen in FIGS. 6 and 9, does not extend out of the slot 48, while in the position seen in FIGS. 5, 8 and 11, extends laterally out of the slot 48. The lower side of the tang 72 is tapered as seen at 74, so that as seen in FIG. 9, when the intermediate member 30 is inserted into opening 26 in the base 11, even if the arm 62 is not pressed upon, the taper 74 will slidingly engage the top of the member 14 adjacent to the opening 26 and pivot the lever to the position seen in FIGS. 6 and 9 so that the intermediate member 30 can be inserted into the base 11.

The upper base 11 is provided with a pair of detents 76 and 78, which detents commence at the bottom of the opening 26 and extend approximately half way up the same, with the detent 78 being disposed on the longitudinal centerline of the rail 12 and the detent 76 being disposed 90 degrees therefrom. Thus, when the intermediate member 30 is positioned with its depending portion 28 disposed in the opening 26, the tang 72 of the latching lever 50 can enter the detent 76 or 78 aligned therewith, with the tang abutting the top of the detent to prevent outward movement of the intermediate member, and the tang abutting the sides of the detent to prevent rotation of the intermediate member relative to the base member beyond that which is allowed by the width of the detent receiving the tang 72. It should be noted that more than two detents can be provide, such as shown in FIGS. 11 and 12 which show four detents, that the detents do not have to be the same width, as seen in FIG. 12 wherein detent 80 is wider than the other detents to allow limited relative rotation of the intermediate member relative to the base to thereby allow some flexing of the Bimini support, or for that matter, a single detent extending three hundred and sixty degrees can be provided which will abut the top of the tang to prevent separation of the intermediate member from the base member while not preventing full rotation.

Figure 7:
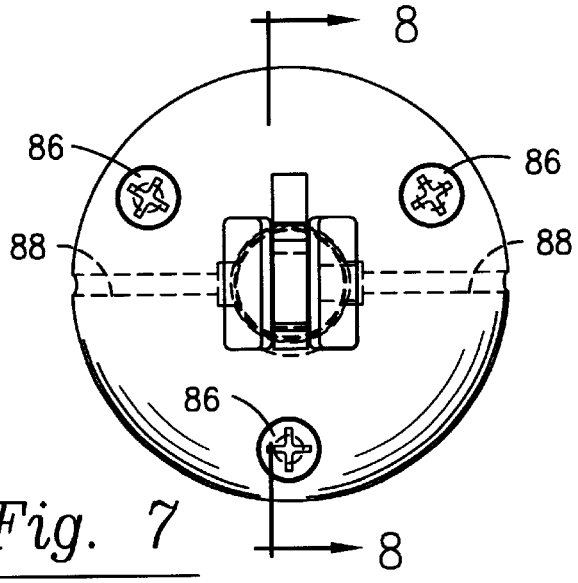
FIG. 7 is a plan view of a second embodiment of this invention.
Figure 8:
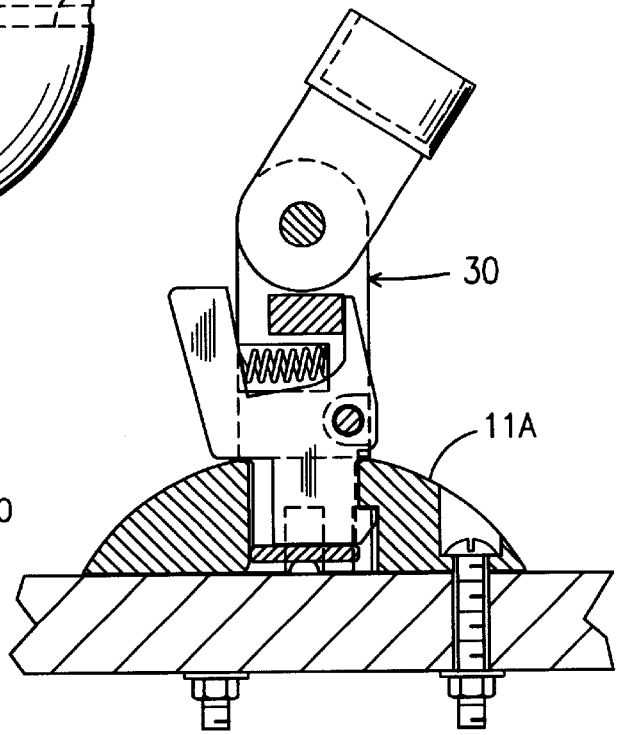
FIG. 8 is a cross sectional view taken along the line 8—8 in FIG. 7; with the latching lever in its engaged position.
Figure 9:
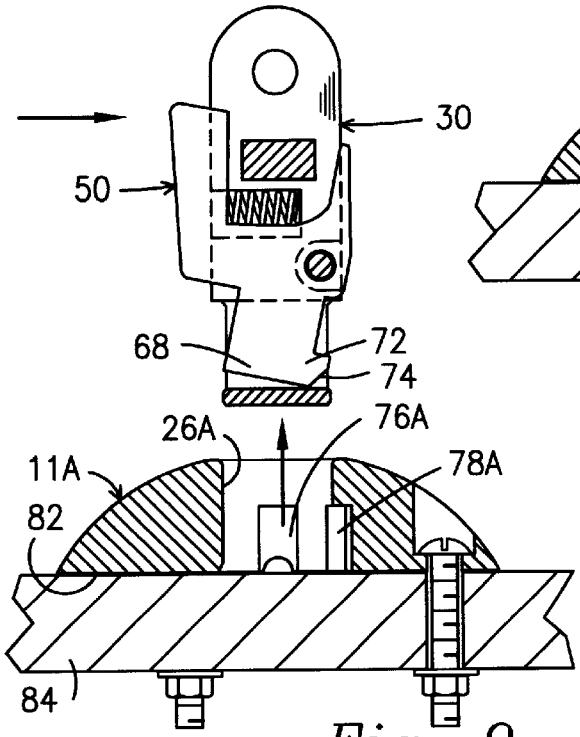
FIG. 9 is a cross sectional view taken in the same manner as FIG. 8 but with the intermediate member displaced from the base member.

Referring now to FIGS. 7, 8 and 9, wherein a surface mounted base 11 A is shown, the intermediate member 30 is the same as that for the embodiment of FIGS. 1–6. The base 11A has a flat lower surface 82 for engaging and being supported by a portion of a vessel shown fragmentarily at 84 and secured thereto by three bolts 86, with the base being provided with drain openings 88 in the lower surface thereof confluent with the opening 26A in the base and open to the periphery thereof to drain any water which may enter the opening 26A. The detents 76A and 78A formed within the opening 26A in the base 1A cooperate with the tang72 of the intermediate member in the same manner as in the embodiment of FIGS. 1–6.

Figure 10:
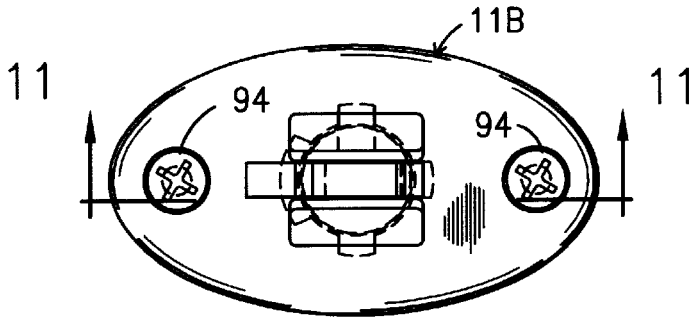
FIG. 10 is a plan view of a third embodiment of this invention.
Figure 11:
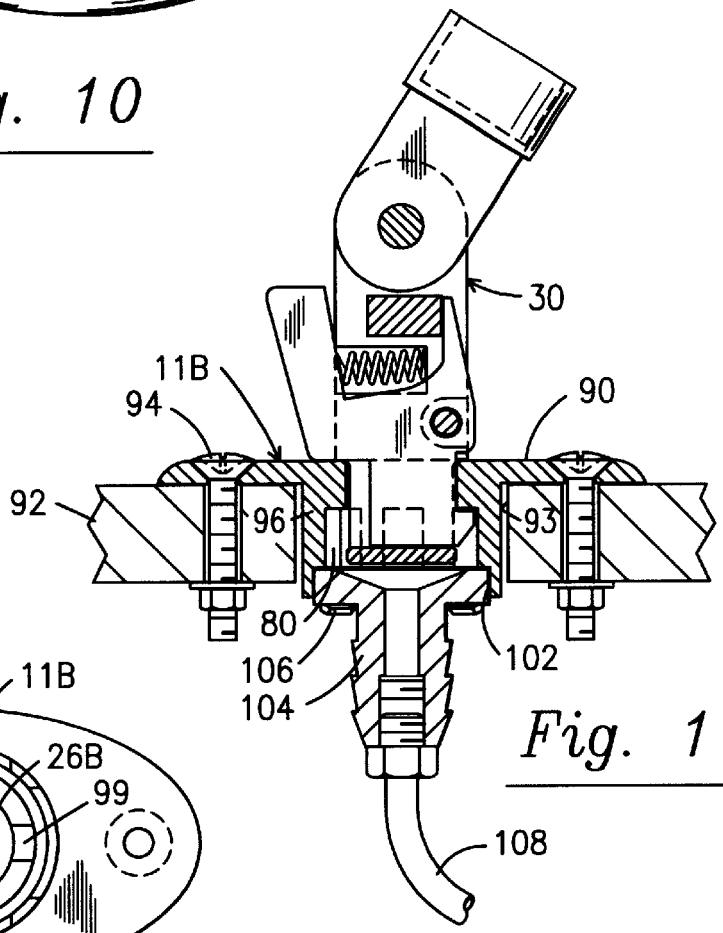
FIG. 11 is a cross sectional view taken along the line 11—11 in FIG. 10.
Figure 12:
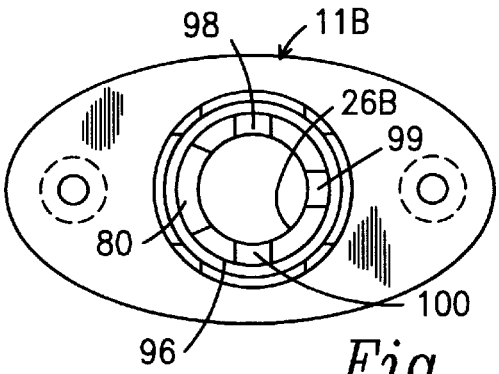
FIG. 12 is a bottom view of the base member of the embodiment of FIG. 10 with the drain plug and the intermediate member removed.

Referring now to the embodiment of FIGS. 10–12, a surface mounted base 11B is shown with a flange 90 resting upon and secured to a portion of a vessel shown fragmentarily at 92 by a plurality of bolts 94. The central portion of the flange has a depending boss 96 thereon, which boss is received in an opening 93 in the vessel 92, and in which boss a vertically extending opening 26B is formed. In the bottom of the opening 26B, a plurality of detents is formed, one of which is the previously discussed detent 80. The other detents, 98,99 and 100, are shown as smaller in width than the detent 80, but as previously discussed, their size can be adjusted to achieve the desired results. The very bottom of the opening 26B is provided with a counterbore 102 in which is received a drain plug 104, secured by staking as shown at 106, which plug carries a drain line 108 which extends therefrom to the bilge of the vessel. While several embodiments of this invention have been shown and described, it is apparent that changes can be made therein without departing from the scope of this invention as defined in the following claims:

What is claimed is:

1. A hinge comprising in combination,

A) a base member having a mounting opening therein,

B) an intermediate member having a first portion thereof received in said opening for relative rotative movement, C) quick release means carried by one of said members for securing said intermediate member to said base member and preventing the separation thereof and including detent means for indexing such relative rotative movement, D) said intermediate member having a second portion thereof remote from said first portion thereof, and E) a mounted member including means connecting said mounted member to said intermediate member for relative pivotal movement.

2. A hinge according to claim 1 wherein said base member has a first and a second base portion and includes means for securing said first and second base portions together, and said base portions have a rail mounting opening therein.

3. A hinge according to claim 2 wherein said rail mounting opening in one of said base portions is formed with more than one radius.

4. A hinge according to claim 3 wherein said rail mounting opening is defined by a pair of spaced lands in said one of said members, said space lands are generated by a first radius, said first lands are separated by a second land which has been generated by a second radius different than said first radius.

5. A hinge comprising in combination,

A) a base member having a mounting opening therein,

B) an intermediate member having a first portion thereof received in said opening, C) quick release means including a releaseable latching lever carried by said intermediate member and engageable with said base member within said mounting opening for securing said intermediate member to said base member, D) said intermediate member having a second portion thereof remote from said first portion thereof, and E) a mounted member including means connecting said mounted member to said intermediate member for relative pivotal movement.

6. A hinge that will accommodate relative movement between its parts in more than a single plane, comprising, A) a base member adapted to be mounted on a surface and having a mounting opening therein, B) an intermediate member having a first portion thereof mounted in said mounting opening and a second portion thereof projecting from said base member, C) quick release means including a releaseable latching lever carried by said intermediate member for securing said intermediate member to said base member and including detent means carried by said base member and engageable by said latching lever, and D) a mounted member including means mounting the same to said intermediate member for pivotal movement relative thereto, 1) said mounted member having a portion thereof formed as a mounting location for an item to be mounted thereon for universal pivotal movement relative to said base member.

7. A hinge according to claim 6 wherein said base member includes a plurality of detent means selectively engageable by said latching lever.

8. A hinge according to claim 7 wherein at least one detent means of said plurality of detent means is circumferentially larger than the other detent means.

9. A hinge according to claim 6 wherein said latching lever has a detent engaging portion extending from said intermediate portion into said detent means.

10. A hinge according to claim 9 wherein said detent means is carried by said base member within said mounting opening.

11. A hinge according to claim wherein said base member has a bottom, said opening opens to said bottom of said base member and said base member has a counterbore therein formed in said bottom of the opening in said base member, and a drain plug is secured in said counterbore.

12. A hinge according to claim 10 wherein said detent means includes a plurality of detents and at least one of said detents is cicumferentially larger than the others.

13. A hinge according to claim 12 wherein said base member has a bottom, said opening opens to said bottom of said base member, and said base member has a counterbore therein formed in said bottom of said base member, and a drain plug is secured in said counterbore.

* * * * *